US010578104B2

(12) United States Patent
Ganshof van der Meersch et al.

(10) Patent No.: US 10,578,104 B2
(45) Date of Patent: Mar. 3, 2020

(54) ROTARY COMPRESSOR ARRANGEMENT WITH ORBITING GUIDE

(71) Applicant: NESTEC S.A., Vevey (CH)

(72) Inventors: Nicolas Ganshof van der Meersch, Vufflens-le-Chateau (CH); Youcef Ait Bouziad, Echandens (CH); Andre Noth, Pully (CH)

(73) Assignee: Societe des Produits Nestle S.A., Vevey (CH)

( * ) Notice: Subject to any disclaimer, the term of this patent is extended or adjusted under 35 U.S.C. 154(b) by 186 days.

(21) Appl. No.: 15/560,531

(22) PCT Filed: Mar. 29, 2016

(86) PCT No.: PCT/EP2016/056751
§ 371 (c)(1),
(2) Date: Sep. 22, 2017

(87) PCT Pub. No.: WO2016/156280
PCT Pub. Date: Oct. 6, 2016

(65) Prior Publication Data

US 2018/0112665 A1 Apr. 26, 2018

(30) Foreign Application Priority Data

Mar. 31, 2015 (EP) ..... 15161944

(51) Int. Cl.
*F04C 27/00* (2006.01)
*F04C 18/344* (2006.01)
(Continued)

(52) U.S. Cl.
CPC ..... *F04C 18/344* (2013.01); *F04C 27/001* (2013.01); *F04C 29/0057* (2013.01); *F04C 29/02* (2013.01); *F04C 2230/601* (2013.01)

(58) Field of Classification Search
CPC .. F04C 18/344; F04C 27/001; F04C 29/0057; F04C 29/02; F01C 21/0836; F01C 1/3442; F01C 1/3443; Y02T 10/17; F02B 53/08
(Continued)

(56) References Cited

U.S. PATENT DOCUMENTS 3,426,735 A * 2/1969 Kelly ..... F01C 1/3442 123/243
4,476,826 A * 10/1984 Stephens ..... F01C 11/004 123/235
(Continued)

FOREIGN PATENT DOCUMENTS

GB 561807 A * 6/1944 ..... F01C 1/3442

*Primary Examiner* — Deming Wan
(74) *Attorney, Agent, or Firm* — K&L Gates LLP

(57) ABSTRACT

Rotary compressor arrangement (100) comprising a body (40) centered at a shaft axis (X) and a cylindrical piston (10) eccentrically arranged with respect to the body (40) such that a chamber is created between them, the arrangement (100) further comprising a satellite element (50) arranged at an offset axis (Y) and orbiting around the shaft axis (X) such that the orbiting of the satellite element (50) entrains in rotation around the shaft axis (X) the cylindrical piston (10) over the body (40), the relative distance between the axis (X, Y) being such that a contact between the body (40) and the cylindrical piston (10) within the chamber is ensured during rotation of the cylindrical piston (10).

17 Claims, 7 Drawing Sheets

(51) Int. Cl.

| | |
|---|---|
| ***F04C 29/00*** | (2006.01) |
| ***F01C 21/08*** | (2006.01) |
| ***F01C 1/344*** | (2006.01) |
| ***F02B 53/02*** | (2006.01) |
| ***F04C 29/02*** | (2006.01) |

(58) Field of Classification Search
USPC ..... 418/140, 143
See application file for complete search history.

(56) References Cited

U.S. PATENT DOCUMENTS

| | | | |
|---|---|---|---|
| 5,399,076 | A | 3/1995 | Matsuda et al. |
| 5,472,327 | A | 12/1995 | Strikis et al. |

* cited by examiner

0°

90°

180°

270°

ROTARY COMPRESSOR ARRANGEMENT WITH ORBITING GUIDE

CROSS REFERENCE TO RELATED APPLICATIONS

The present application is a National Stage of International Application No. PCT/EP2016/056751, filed on Mar. 29, 2016, which claims priority to European Patent Application No. 15161944.2, filed on Mar. 31, 2015, the entire contents of which are being incorporated herein by reference.

FIELD OF THE INVENTION

The present invention is directed to a rotary compressor arrangement and, more specifically, to a rotary compressor arrangement of the vane type preferably used in a cooling or refrigerating system.

BACKGROUND OF THE INVENTION

Currently, different types of compressors are used in cooling or refrigeration systems. For home applications, vane rotary compressors are commonly used thanks to their reduced size.

Typically, a vane rotary compressor comprises a circular rotor rotating inside of a larger circular cavity configured by the inner walls of the compressor housing. The centers of the rotor and of the cavity are offset, causing eccentricity. Vanes are arranged in the rotor and typically slide into and out of the rotor and are tensioned to seal on the inner walls of the cavity, in order to create vane chambers where the working fluid, typically a refrigerant gas, is compressed. During the suction part of the cycle, the refrigerant gas enters through an inlet port into a compression chamber where the volume is decreased by the eccentric motion of the rotor and the compressed fluid is then discharged through an outlet port.

While small sized vane rotary compressors are advantageous, leaking of refrigerant through the surfaces of the inner walls of the compressor housing is disadvantageous. This is why these compressors also use lubricating oil, having two main functions: one is to lubricate the moving parts, and the second one is to seal the clearances between the moving parts, which minimizes gas leakage that can adversely affect the efficiency of the compressor.

Known in the state of the art are small sized compressors of the rotary vane type such as the one described in EP 1831561 B1, where the losses of the refrigerant are countered by making very specific design and maintaining the dimensions of the parts of the compressor under extremely tight tolerances in order to still provide a good compressor performance while maintaining a miniature scale. The result is that small deviations in these tolerances would largely affect the efficiency of the compressor and, at the same time, the compressor so designed is very complex to manufacture and is very costly.

Document KR 101159455 discloses a rotary vane compressor where a shaft joined to a rotor rotates guided by a plurality of ball bearings: the problem of such a configuration is that these bearings respond as hard points allowing no flexibility in this rotation, thus preventing any adjustment or absorption of shocks by the system, which can be thus easily damaged in certain cases.

The present invention comes to solve the above-described problems of the state of the art, as it will be further explained. The invention also aims at other objects and particularly the solution of other problems as will appear in the rest of the present description.

OBJECT AND SUMMARY OF THE INVENTION

According to a first aspect, the invention refers to a rotary compressor arrangement comprising a body centered at a shaft axis X and a cylindrical piston eccentrically arranged with respect to the body, such that a chamber is created between them. The rotary compressor arrangement further comprises a satellite element arranged at an offset axis Y and orbiting around the shaft axis X such that the orbiting of the satellite element entrains in rotation around the shaft axis X the cylindrical piston over the body, the relative distance between the axis X, Y being such that a contact between the body and the cylindrical piston within the chamber is ensured during rotation of the cylindrical piston.

Typically, the rotary compressor arrangement of the invention further comprises at least a sealing piston slidable within the body during rotation of the cylindrical piston in such a way that it contacts the inner wall of the cylindrical piston.

Preferably, the rotary compressor arrangement further comprises at least a tensioning device exerting pressure over the at least one sealing piston so that it contacts the inner wall of the cylindrical piston as it rotates around the body. Preferably, the at least one sealing piston creates at least one compression chamber whose volume is decreased by the eccentric motion of the cylindrical piston so that a compressible fluid is compressed before being discharged.

Preferably, the satellite element rotates around its offset axis Y while orbiting around the shaft axis X, in opposite direction to the rotation of the cylindrical piston over the body.

According to the invention, the rotary compressor arrangement further preferably comprises a motor 52 driving the satellite element 50 to orbit around the shaft axis X. More preferably, the satellite element orbits around the shaft axis X at a speed comprised between 2000 and 6500 rpm.

Moreover, the offset axis Y is preferably configured pre-stressed to ensure is configured pre-stressed to ensure constant contact between the satellite element and the cylindrical piston during rotation of the cylindrical piston.

According to the invention, the rotary compressor arrangement further comprises a calibration device configured to determine or establish the distance between the axes X, Y.

Typically, the compressible fluid in the rotary compressor arrangement of the invention comprises a refrigerant gas. Moreover, lubricating oil can be provided together with the compressible fluid, this lubricating oil being compatible with the compressible fluid.

Besides, the rotary compressor arrangement typically comprises an upper plate and a lower plate arranged to close in height in a tight manner at least one compression chamber created between the body and the cylindrical piston. Preferably, according to the invention, at least one segment element is arranged between the upper and/or lower plates to allow a tight sealing of at least one compression chamber and the movement of the cylindrical piston. More preferably, the at least one segment element comprises a low friction material.

According to a second aspect, the invention refers to a cooling or refrigerating system comprising a rotary compressor arrangement as the one previously described.

BRIEF DESCRIPTION OF THE DRAWINGS

Further features, advantages and objects of the present invention will become apparent for a skilled person when reading the following detailed description of embodiments of the present invention, when taken in conjunction with the figures of the enclosed drawings.

DETAILED DESCRIPTION OF EXEMPLARY EMBODIMENTS

As shown in any of FIGS. 2*a-d* for example, the present invention relates to a vane rotary compressor arrangement, called in what follows rotary compressor arrangement 100 or simply rotary compressor 100. The rotary compressor 100 of the invention is preferably used in cooling or refrigerating systems, and the working fluid is typically any compressible gas, preferably a refrigerant gas or a mixture comprising a refrigerant gas.

The rotary compressor 100 comprises an inlet 130 through which the working fluid enters the compressor and an outlet 140 through which this fluid, once compressed, exits the mentioned compressor.

Figure 3:
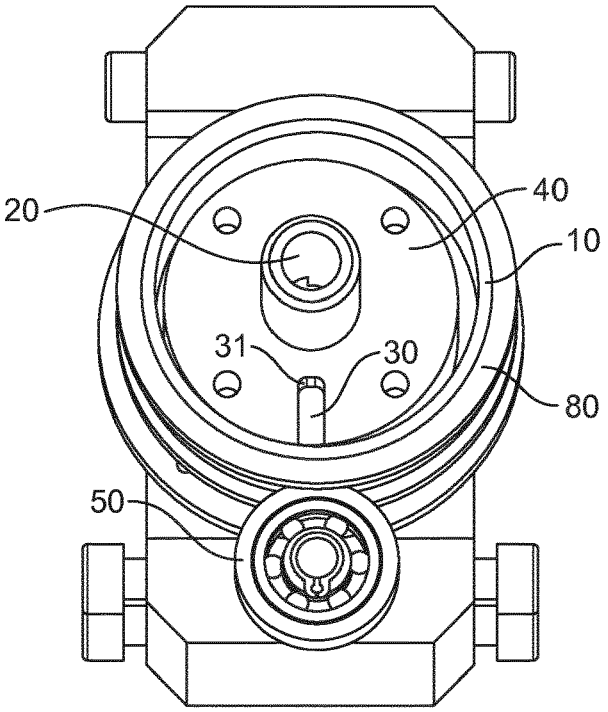
FIG. 3 shows a top side view of the rotary compressor arrangement according to the present invention.
Figure 4:
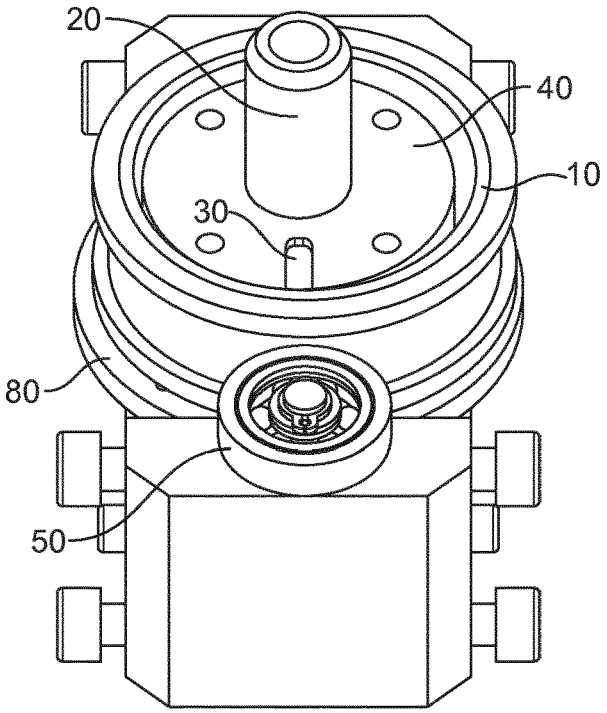
FIG. 4 shows a side view of the rotary compressor arrangement according to the present invention.

The compressor of the invention further comprises a cylindrical piston 10 inside of which a body 40 is arranged centered by an axis shaft X. The compressor also comprises a vane or sealing piston 30 which can slide into a slot 31 in order to contact the internal walls of the cylindrical piston 10 and create a tight compression chamber where fluid will be compressed, as it will be further explained in more detail. As shown in FIG. 3 or 4, the body 40 is arranged eccentrically inside the cylindrical piston 10. Also as shown in any of FIGS. 2*a-d*, the inlet 130 and the outlet 140 for the working fluid are arranged in the body 40, and are preferably arranged in the vicinity of the sealing piston 30.

The arrangement of the invention is made in such a way that the shaft 20 and the body 40 are one single piece within the rotary compressor 100 and are static. However, it is the cylindrical piston 10 which rotates around the body 40 (in fact, around the body 40 together with the shaft 20) entrained in rotation by means of a satellite element 50. The sealing piston 30 is slidable within the slot 31 arranged in the body 40: pressure is maintained in this slot 31 to make the sealing piston 30 contact the inner wall of the cylindrical piston 10 during the whole rotation of the cylindrical piston 10 with respect to the body 40. For this to happen the arrangement of the present invention comprises a tensioning device inside the slot 31 exerting pressure over the sealing piston 30 so that it contacts the inner wall of the cylindrical piston 10: any kind of tensioning device providing such functionality can be used in the arrangement os the present invention, typically a spring, though a pneumatic device is also possible. In the arrangement of the present invention, as shown in FIGS. 2*a-d*, the sealing piston 30 creates a compression chamber 110 between the body 40 and the cylindrical piston 10 of a variable volume (the volume in the compression chamber 110 will decrease with the movement of the sealing piston 10 with respect to the body, as represented for different times/angles of rotation in FIGS. 2*a-b-c-d*, thus compressing the fluid inside before it is discharged through the fluid outlet 140).

Therefore, the referential system in the rotary compressor 100 of the invention is actually inverted, the body 40 being fixed and the cylindrical piston 10 being the part rotating around the fixed body 40.

The Figures in the present patent application show one embodiment of the invention with only one sealing piston 30: however, it is also possible according to the invention and comprised within the scope of it, that the rotary compressor arrangement comprises more than one sealing piston 30, so more than one compression chamber 110 is formed between the body 40 and the cylindrical piston 10. In this case, there would be more than one fluid outlet 140 through which the compressed fluid would be dispensed after having been compressed (compression occurring in several steps).

The arrangement of the invention also comprises a satellite element 50 as shown in FIG. 2 for example, which is located offset, at an offset axis Y, with respect to the shaft axis X of the cylindrical piston 10. The satellite element 50 orbits around the cylindrical piston 10 and is arranged in such a way with respect to it that it entrains in rotation the cylindrical piston 10. In fact, the satellite element 50 contacts the external wall of the cylindrical piston 10 under certain pressure or force (i.e. the distance between the axis X and Y is such that this force is exerted and maintained during the whole orbiting of the satellite element): this contact of the satellite element 50 and the external wall of the cylindrical piston 10 under pressure makes that the satellite element 50 entrains in rotation the cylindrical piston 10 around the body 40, similar as in a gear arrangement. The satellite element 50 drives in rotation and also guides the cylindrical piston 10 around the body 40. The satellite element 50 rotates around its axis Y in a direction opposite to the direction of rotation which is entrained into the cylindrical piston 10. The main functions of the satellite element 50 are to guide and create the rotation of the cylindrical piston 10, exerting and maintaining a certain pressure between the external surface of the body 40 and the inner wall of the cylindrical piston 10 contacting the body 40, during the rotation of the cylindrical piston 10 around the body 40. Besides, the sealing piston 30 will be tightly contacting one part of the inner wall of the cylindrical piston 10 so that a tight compression chamber 110 is created having variable volume (decreasing with time) where the working fluid is compressed inside the compressor arrangement 100.

Figure 6:
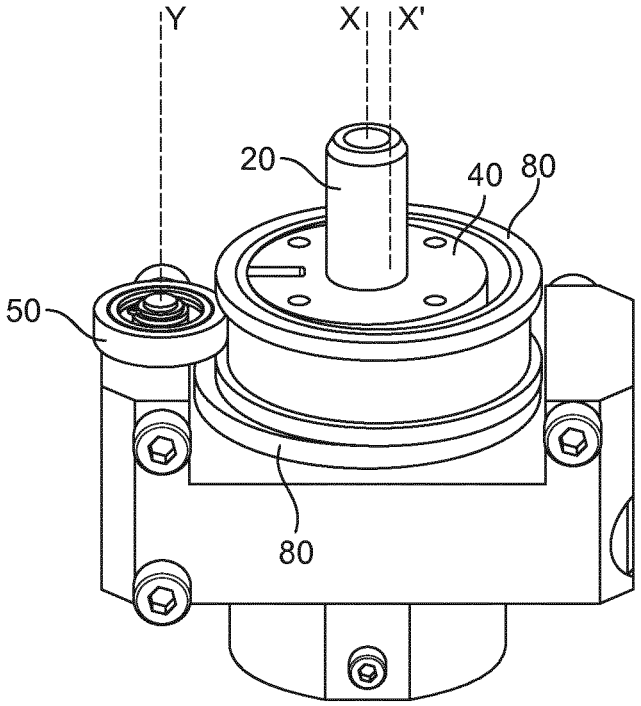
FIG. 6 shows a side view of the rotary compressor arrangement according to the present invention.
Figure 7:
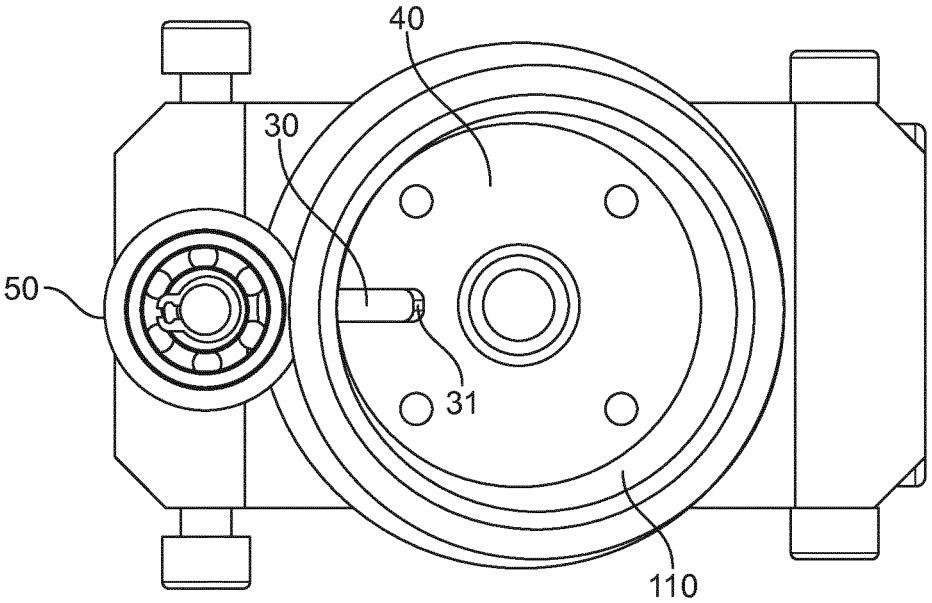
FIG. 7 shows a top view of the rotary compressor arrangement according to the present invention.

As shown in FIG. 6, the body 40 is centered according to a shaft axis X, while the satellite element 50 is centered at an axis Y, called offset axis Y, which is offset with respect to the shaft axis X. As depicted in this Figure, the cylindrical piston 10 is centered according to an axis X' which has is arranged at a certain distance with respect to the shaft axis X: therefore, the body 40 and the cylindrical piston 10 are eccentrically arranged with respect to each other. According to the arrangement of the invention, the satellite element 50 presses over the external wall of the cylindrical piston 10 during the movement of the cylindrical piston 10 so that there is always a contact between the body 40 and the cylindrical piston 10 aiming at a substantially no-gap adjustment in this contact, so the distance between the offset axis Y and the shaft axis X, the distance between the offset axis Y and the cylindrical piston axis X' and the distance between the shaft axis X and the cylindrical piston axis X' are all maintained substantially constant during the rotation of the cylindrical piston 10 with respect to the body 40. In fact, the satellite element 50 presses over the external wall of the cylindrical piston 10 to obtain a no-gap adjustment between the body 40 and the inner walls of the cylindrical piston 10 at a contact point within the chamber 110 (see evolution in FIGS. 2*a-b-c-d*): the fact that there is substantially no gap at this point combined with the satellite element 50 orbiting around the shaft axis X has the effect of entraining in rotation the cylindrical piston 10 over the body 40. It is also evident from FIGS. 2*a-d* that this contact point is aligned with the location of the satellite element 50.

FIGS. 2*a*, 2*b*, 2*c* and 2*d* attached show in more detail different times in the movement of the satellite element 50 and the cylindrical piston 10 around the body 40: for the sake of clarity, a complete orbital movement of 360° of the satellite element 50 and, therefore, of the cylindrical piston 10 has been represented, for four specific moments in time, starting angle 0°, 90°, 180° and 270°. The positioning of the moving elements of the system, i.e. satellite 50 and cylindrical piston 10, with respect to the fixed element, i.e. body 40, is clearly represented in the above-mentioned Figures. The sealing piston 30 in fact only moves inside the slot 31 in order to always maintain proper contact with the inner walls of the moving cylindrical piston 10. This guarantees that the compression chamber 110 is tightly maintained so that the working fluid can be compressed inside it as its volume decreases with time (i.e. decreases with the rotation of the cylindrical piston 10 with respect to the body 40, shown for different times of movement of the satellite element 50 as represented in cited FIGS. 2*a-d*).

Figure 9:
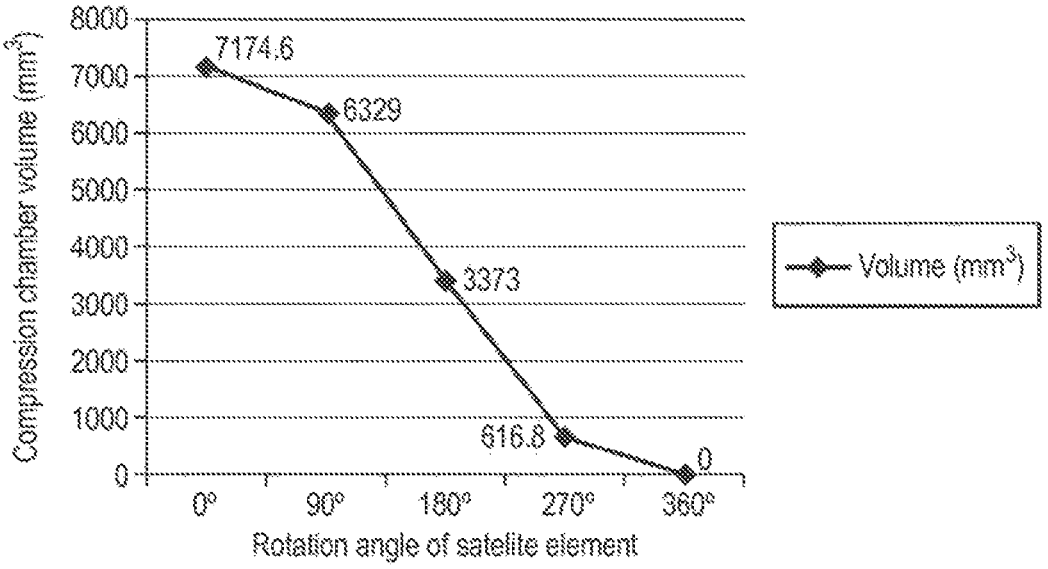
FIG. 9 shows a graph with the variation of volume in the compression chamber with respect to time during moving of a rotary compressor arrangement according to the present invention.

Furthermore, the graph disclosed in FIG. 9 shows the variation of the volume in the compression chamber 110 with time as a function of the positioning and movement of the satellite element 50 with respect to the body 40. The values comprised in this graph should be taken as simply explanatory, though other values would be possible and therefore comprised within the scope of the present invention.

Figure 5:
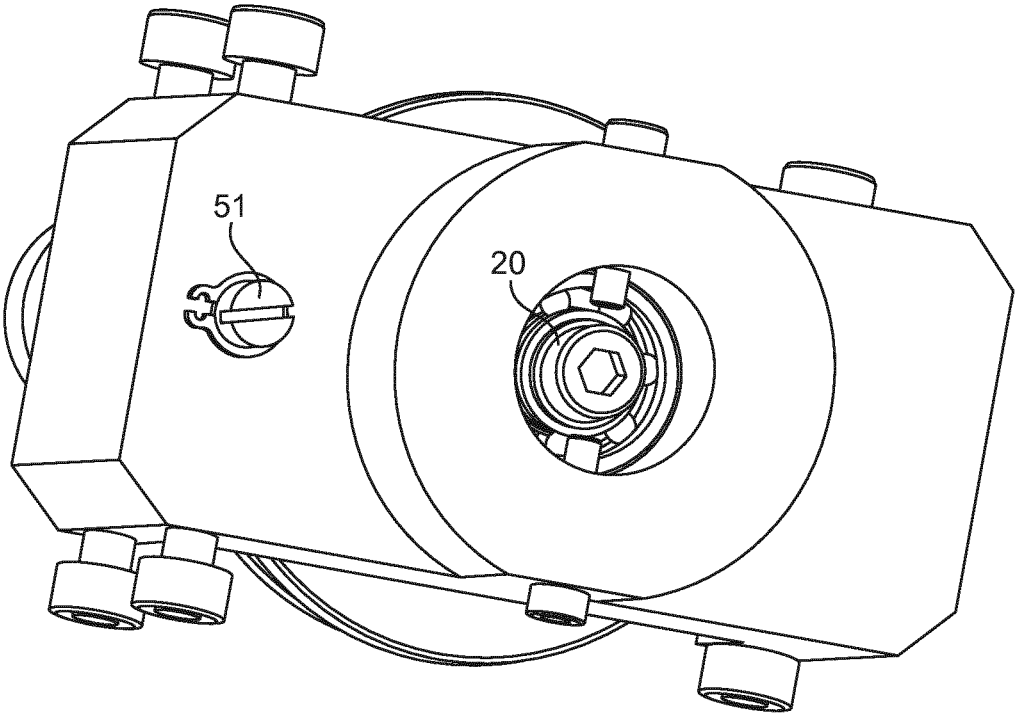
FIG. 5 shows a bottom view of the rotary compressor arrangement according to the present invention.

The pressure exerted between the body 40 and the cylindrical piston 10 can be calibrated as desired before the compressor starts functioning by means of acting on a calibrating device, preferably a calibrating element 51, typically a screw, as shown in FIG. 5. Once calibrated, the pressure exerted by the satellite element 50 must be such that allows a no-gap adjustment between the body 40 and the inner walls of the cylindrical piston 10. This allows entraining in rotation the cylindrical piston 10 around the body 40.

The satellite element 50 can be configured as a ball bearing, though it can be made into different configurations as long as they exert certain pressure and drive in rotation the cylindrical piston 10 during its rotation with respect to the body 40. One of the main objects of the system of the invention is to remove radial tolerances as existing in the known prior art (which have to be really tight, precise and make the system complicated and costly) and use instead an adjusting system much more simple: the arrangement of the invention uses a satellite element 50 that presses over the outer wall of the cylindrical piston 10; moreover, contact is ensured between the inner wall of this cylindrical piston 10 and the body 40, therefore creating a so-called no-gap adjustment between them which is maintained during the rotation of the cylindrical piston 10 over the fixed body 40 and shaft 20.

Furthermore, preferably according to the invention, the offset axis Y (or satellite element axis) is configured pre-stressed in order to have a certain flexibility, also allowing its calibration over the cylindrical piston 10: this is an important feature as the fact that the offset axis Y is configured pre-stressed ensures that the distance between axes X, Y is kept substantially constant during the rotation of the cylindrical piston 10. This allows that there is substantially no-gap adjustment between the external walls of the body 40 and the inner walls of the cylindrical piston 10 during the rotation of the cylindrical piston 10 over the body 40. This pre-stress allows the offset axis Y to work as a spring, pressing over the cylindrical piston 10 when needed or relieving tension over it when not needed, therefore adjusting this no-gap between the two. This provides a further advantage of the arrangement of the invention as eventual hard points or shocks can be absorbed during functioning, something not possible in the known prior art configurations.

Typically, the compressor of the invention works with a refrigerant gas as working fluid, and oil is also entrained with the refrigerant in the compressor, in order to lubricate the moving parts and to seal the clearances or gaps between them. Oil is preferably introduced in the compressor by an oil pump (not shown) and there is also typically provided a device (not shown) to gather this oil and return it to the oil pump so that it is pumped once again together with the refrigerant. The lubricating oil may be any oil compatible with the refrigerant used as working fluid in the compressor. The refrigerant may be any suitable refrigerant that is effective in a given temperature range of interest.

The shaft 20 is now made symmetric with respect to the axial center of the compressor and is centered with the body 40, therefore it is made much more simple to manufacture compared to the existing solutions in the prior art.

Figure 8:
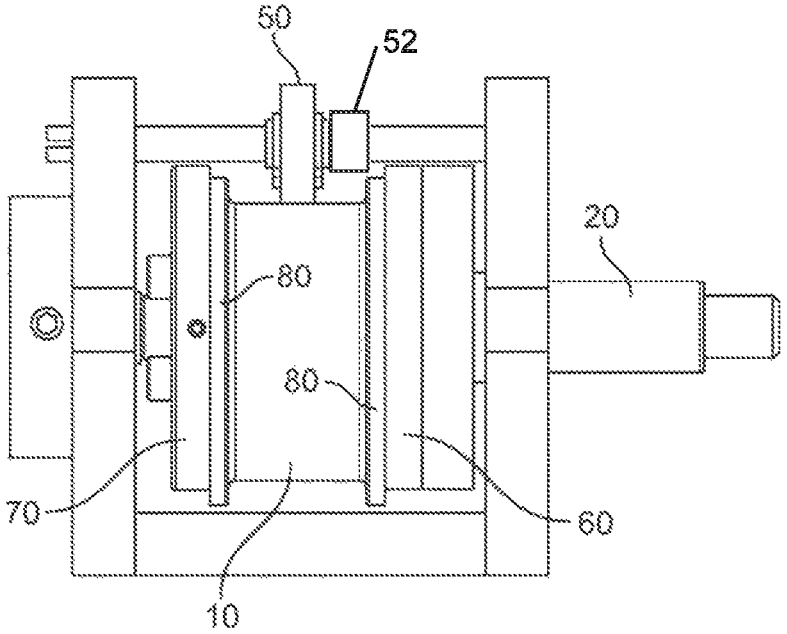
FIG. 8 shows the arrangement of the satellite axis with respect to the rotor shaft in a rotary compressor arrangement according to the present invention.

Typically, the compressor arrangement of the invention also comprises an upper plate 60 and a lower plate 70, as shown in FIG. 8. The upper and lower plates 60, 70 close the upper and lower parts of the compressor, thus sealing the compression chamber 110 created together with the sealing piston 30. Both the upper and the lower plates 60, 70 are fixed on the shaft 20. The distance between the two surfaces, 60 and 70, and the height of the body configuring the cylindrical piston 10 must be precise in order to correctly seal and create the compression chamber 110 and in fact the second chamber 120, called in what follows admission chamber 120, though a certain clearance adjustment or compensation is feasible acting on the satellite element 50. However, no other parts configuring the compressor arrangement of the invention are needed to be done with precise tolerances as it is the case in the known prior art, which makes this arrangement much easier to be manufactured and consequently less costly.

Figure 1A:
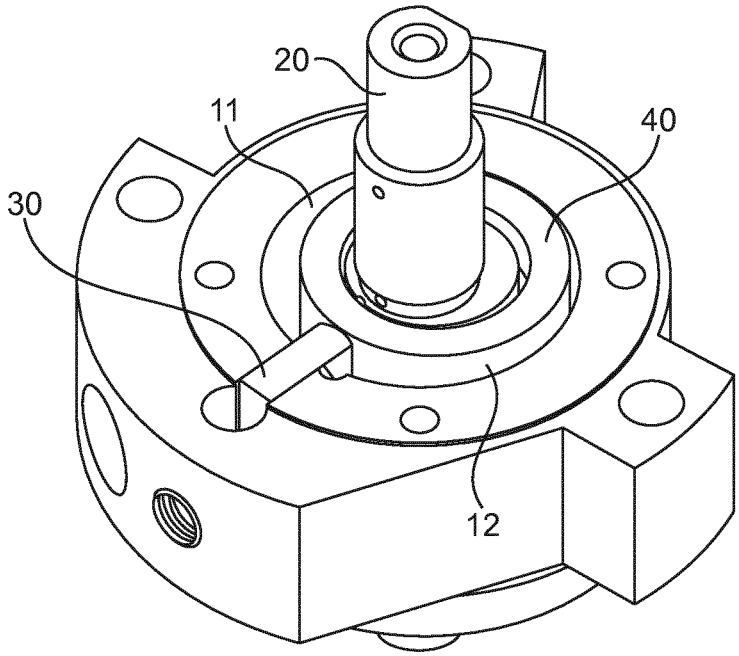
FIG. 1a (PRIOR ART)
FIGS. 1*a* and 1*b* show different views of a rotary compressor arrangement known in the prior art.
Figure 1B:
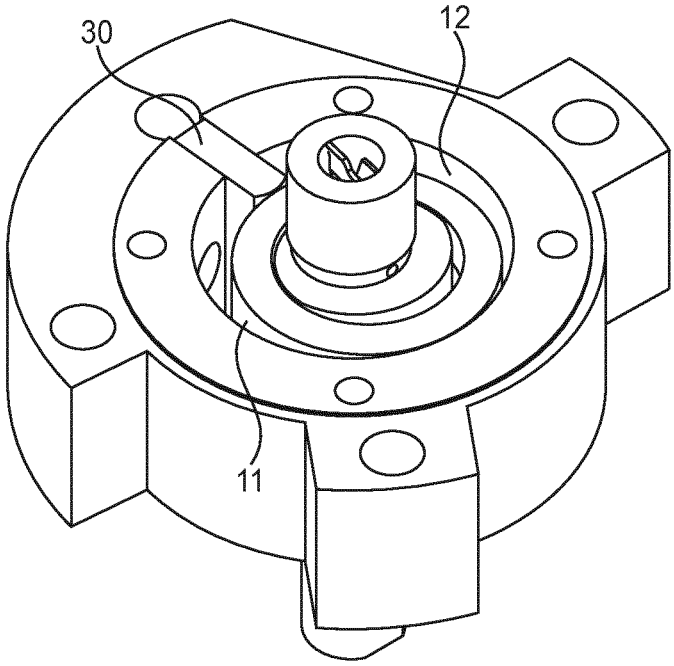
FIG. 1b (PRIOR ART)
Figure 2A:
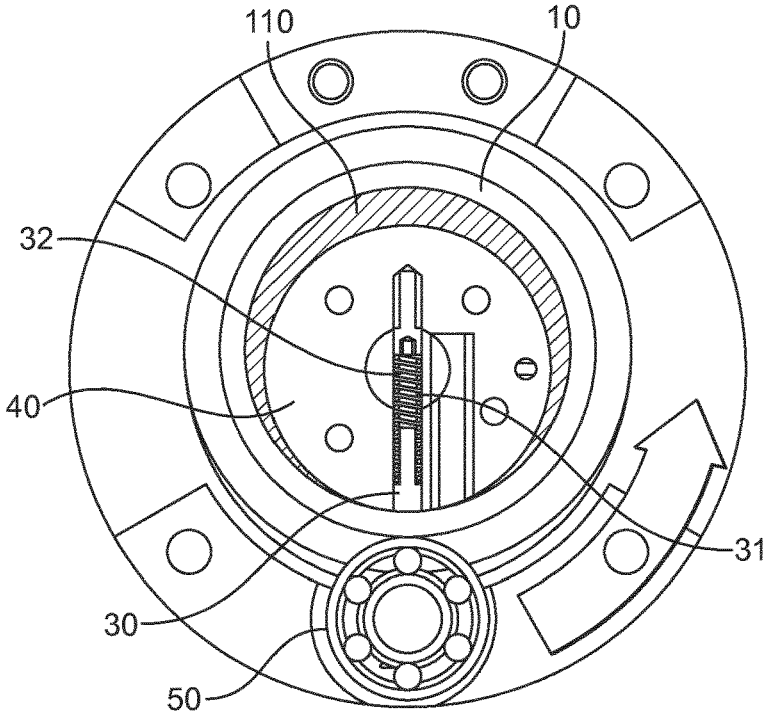
FIG. 2*a-d* show different views in time of the movement of the rotary compressor arrangement according to the present invention.
Figure 2B:
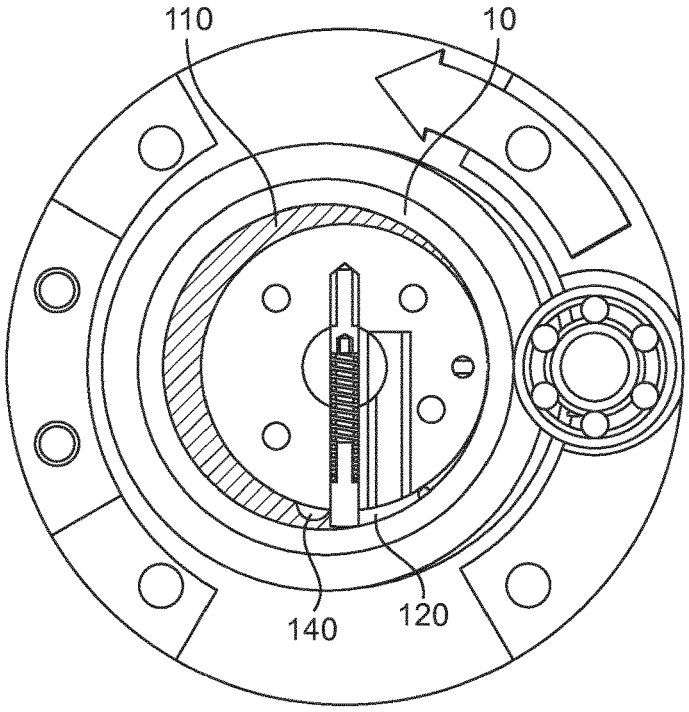
Figure 2C:
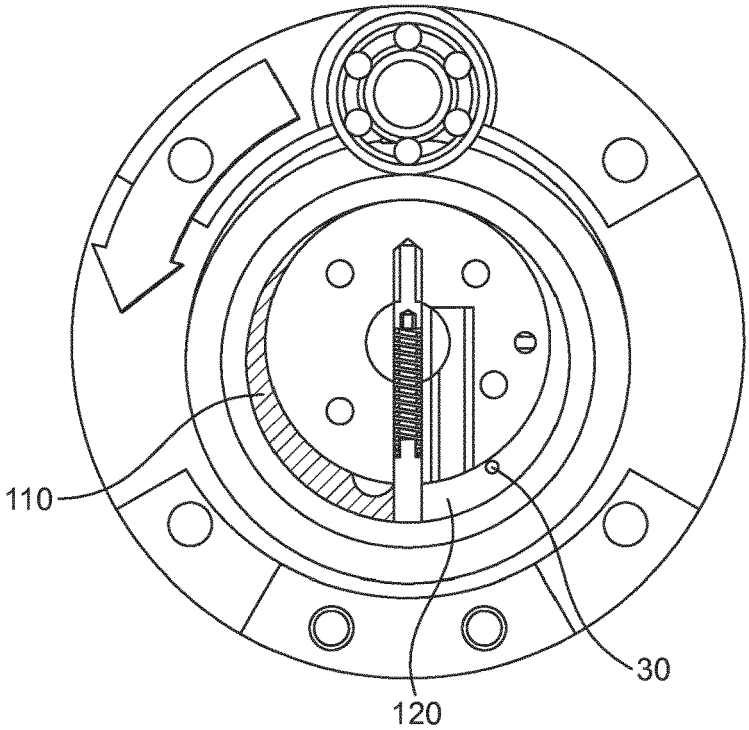
Figure 2D:
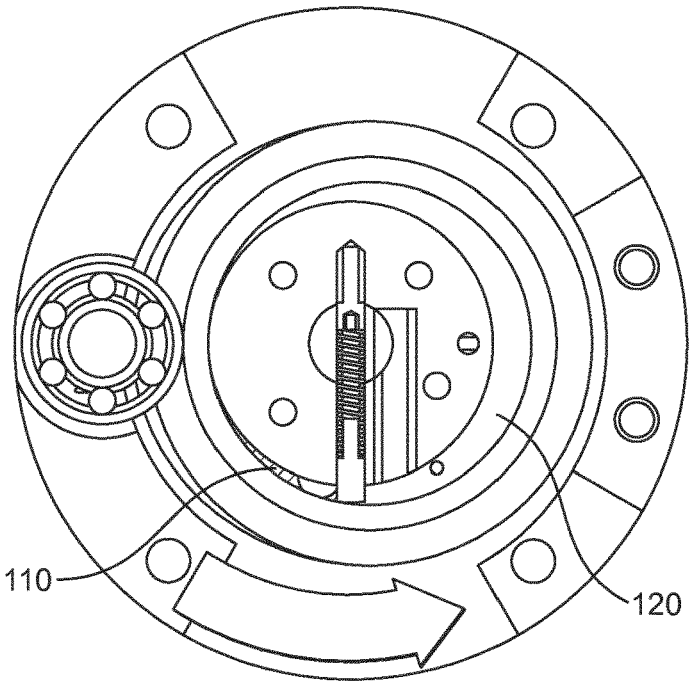

Contrary to the arrangement in the known prior art systems, as shown for example in FIG. 1*a* or 1*b*, the sealing piston 30 is no longer in the moving part of the compressor (i.e. in the rotor, in the prior art) but in a fixed part of it (in the body 40).

According to the invention, as shown for example in FIG. 3 or 4, at least one segment element 80 is further arranged between the upper and/or lower plates 60, 70 to allow a tight sealing of the compression chamber 110 and of the admission chamber 120 and at the same time allow the movement of the cylindrical piston 10. This arrangement is done in such a way that lower friction in the movement of the cylindrical piston 10 with respect to the body 40 and the plates 60, 70 is allowed. Preferably, the material configuring the segment element 80 is a low friction material, typically Teflon®. Typically, as depicted in FIG. 3 or 4, two separated segment elements 80 are arranged preferably outside the cylindrical piston 10: also, a guiding path is typically created (see FIG. 4) to cooperate and help the guidance of the satellite element 50.

These low friction materials allow long life solutions typically in applications where the sliding action of parts is needed, still with low maintenance being required. The friction characteristics of a material are given typically by the coefficient of friction, which gives a value showing the force exerted by a surface made of such a material when an object moves across it, such that a relative motion exists between the two, the object and the surface. Typically, for Teflon, this coefficient of friction is comprised between 0.04 and 0.2. Low friction materials have a coefficient of friction below 0.4, more preferably below 0.3 and even more preferably below 0.2.

Compared to systems known in the state of the art, for example as depicted in FIG. 1*a* or 1*b*, the main differences and advantages of the rotary compressor 100 according to the invention are shown below:

The arrangements in the prior art comprise a fixed part (the compressor housing) and two movable parts (the rotor and the shaft); the arrangement needs to have an extremely precise adjustment in the order of microns and, because tolerances are added, there is a need to be extremely precise on the internal diameter of the compressor housing, on the thickness of the rotor and on the sealing piston or vane.

The rotary compressor 100 of the invention is an arrangement comprising a fixed part (body 40 together with shaft 20) and two movable parts (cylindrical piston 10 and satellite element 50) but the ensemble does not need to have any defined precision: errors on the diameter of the shaft 20, on the thickness of the cylindrical piston 10 and on the radius of the rotation of the satellite element 50 can be compensated by the satellite element 50 arrangement.

Although the present invention has been described with reference to preferred embodiments thereof, many modifications and alternations may be made by a person having ordinary skill in the art without departing from the scope of this invention which is defined by the appended claims.

REFERENCES

100 Rotary compressor
- 10 Cylindrical piston
- 20 Shaft
- X Shaft axis
- X' Cylindrical piston axis
- 30 Sealing piston
  - 31 Slot
- 40 Body
- 50 Satellite element
  - Y Offset axis
  - 51 Calibrating element
- 60 Upper plate
- 70 Lower plate
- 80 Segment element
- 110 Compression chamber
- 120 Admission chamber
- 130 Fluid inlet
- 140 Fluid outlet Prior Art

11, 12 Compression chambers

The invention claimed is:

1. A rotary compressor arrangement comprising a body centered at a shaft axis and a cylindrical piston eccentrically arranged with respect to the body such that a chamber is created between the cylindrical piston and the body, the arrangement comprising a satellite element arranged at an offset axis and orbiting around the shaft axis such that the orbiting of the satellite element entrains the cylindrical piston over the body in rotation around the shaft axis, a relative distance between the shaft axis and the offset axis being such that a contact between the body and the cylindrical piston within the chamber is ensured during rotation of the cylindrical piston.

2. The rotary compressor arrangement according to claim 1 comprising at least one sealing piston slidable within the body during rotation of the cylindrical piston in such a way that the at least one sealing piston contacts an inner wall of the cylindrical piston.

3. The rotary compressor arrangement according to claim 2 further comprising a tensioning device exerting pressure over the at least one sealing piston so that the at least one sealing piston contacts the inner wall of the cylindrical piston as the at least one sealing piston rotates around the body.

4. The rotary compressor arrangement according to claim 2 wherein the at least one sealing piston creates at least one compression chamber, a volume of the at least one compression chamber is decreased by rotation of the cylindrical piston.

5. The rotary compressor arrangement according to claim 4 wherein the arrangement comprises a compressible fluid within the at least one compression chamber.

6. The rotary compressor arrangement according to claim 5, wherein the arrangement comprises lubricating oil together with the compressible fluid, the lubricating oil being compatible with the compressible fluid.

7. The rotary compressor arrangement according to claim 5, wherein the compressible fluid comprises a refrigerant gas.

8. The rotary compressor arrangement according to claim 4 comprising an upper plate and a lower plate arranged to close in height in a tight manner the at least one compression chamber created between the body and the cylindrical piston.

9. The rotary compressor arrangement according to claim 8 comprising at least one segment element arranged between the upper plate and/or the lower plate to provide a tight sealing of the at least one compression chamber and allow movement of the cylindrical piston.

10. The rotary compressor arrangement according to claim 9 wherein the at least one segment element comprises a low friction material.

11. The rotary compressor arrangement according to claim 1 wherein the satellite element rotates around the offset axis while orbiting around the shaft axis, in opposite direction to the rotation of the cylindrical piston over the body.

12. The rotary compressor arrangement according to claim 1, wherein the satellite element is configured to orbit around the shaft axis at a speed comprised between 2000 and 6500 rpm.

13. The rotary compressor arrangement according to claim 1 wherein the offset axis is configured pre-stressed to ensure constant contact between the satellite element and the cylindrical piston during rotation of the cylindrical piston.

14. The rotary compressor arrangement according to claim 1 comprising a screw configured to establish the distance between the offset axis and the shaft axis.

15. A rotary compressor arrangement comprising a body centered at a shaft axis and a cylindrical piston eccentrically arranged with respect to the body such that a chamber is created between the cylindrical piston and the body, the arrangement comprising a satellite element arranged at an offset axis and orbiting around the shaft axis such that the orbiting of the satellite element entrains the cylindrical piston over the body in rotation around the shaft axis, the arrangement comprising a motor configured for driving the satellite element to orbit around the shaft axis, a relative distance between the shaft axis and the offset axis being such that a contact between the body and the cylindrical piston within the chamber is ensured during rotation of the cylindrical piston.

16. A cooling refrigerating system comprising:

a rotary compressor arrangement comprising a body centered at a shaft axis and a cylindrical piston eccentrically arranged with respect to the body such that a chamber is created between the body and the cylindrical piston, the arrangement comprising a satellite element arranged at an offset axis and orbiting around the shaft axis such that the orbiting of the satellite element entrains the cylindrical piston over the body in rotation around the shaft axis, a relative distance between the shaft axis and the offset axis being such that a contact between the body and the cylindrical piston within the chamber is ensured during rotation of the cylindrical piston;

an inlet configured to allow a working fluid to enter the arrangement and an outlet configured to allow the working fluid to exit the arrangement.

17. The cooling/refrigerating system according to claim 16 comprising a motor configured for driving the satellite element to orbit around the shaft axis.

* * * * *